US011638858B2

(12) United States Patent
Mackie

(10) Patent No.: US 11,638,858 B2
(45) Date of Patent: May 2, 2023

(54) TRAINING BALL

(71) Applicant: Christopher Jon Mackie, Lewisville, NC (US)

(72) Inventor: Christopher Jon Mackie, Lewisville, NC (US)

(73) Assignee: ELYSIAN ONE, INC., Tacoma, WA (US)

( * ) Notice: Subject to any disclaimer, the term of this patent is extended or adjusted under 35 U.S.C. 154(b) by 63 days.

(21) Appl. No.: 17/192,576

(22) Filed: Mar. 4, 2021

(65) Prior Publication Data

US 2022/0105393 A1 Apr. 7, 2022

Related U.S. Application Data

(60) Provisional application No. 63/086,654, filed on Oct. 2, 2020.

(51) Int. Cl.

| | |
|---|---|
| ***A63B 43/00*** | (2006.01) |
| ***A63B 37/14*** | (2006.01) |
| *A63B 102/18* | (2015.01) |

(52) U.S. Cl.

CPC ..... *A63B 37/14* (2013.01); *A63B 43/002* (2013.01); *A63B 2102/18* (2015.10)

(58) Field of Classification Search

CPC ... A63B 37/14; A63B 43/002; A63B 2102/18; A63B 2071/0694; A63B 2037/065

See application file for complete search history.

(56) References Cited

U.S. PATENT DOCUMENTS

| | | | | | |
|---|---|---|---|---|---|
| 3,110,494 | A * | 11/1963 | Morgan | A63B 69/0002 473/458 |
| 4,874,169 | A * | 10/1989 | Litchfield | A63B 37/14 473/613 |
| 5,280,906 | A * | 1/1994 | Vitale | A63B 43/00 273/DIG. 20 |
| D351,203 | S * | 10/1994 | Handy | D21/713 |
| 5,700,211 | A * | 12/1997 | Mackie | A63B 43/00 473/613 |
| 6,354,970 | B1 * | 3/2002 | Reinke | A63B 69/0002 473/600 |
| D469,824 | S * | 2/2003 | Manville | D21/498 |
| D577,396 | S * | 9/2008 | Burger | D21/713 |
| D580,112 | S * | 11/2008 | Stiles | D21/713 |
| D609,290 | S * | 2/2010 | Oblack | D21/713 |
| D648,406 | S * | 11/2011 | Hochberg | D21/713 |
| D822,295 | S * | 7/2018 | Woods | D30/160 |
| D822,842 | S * | 7/2018 | Viner | D24/211 |

(Continued)

*Primary Examiner* — Steven B Wong

(74) *Attorney, Agent, or Firm* — Kali Law Group, P.C.

(57) ABSTRACT

Training balls are presented including: a solid sphere defining a first hemisphere and a second hemisphere; a tactile feature positioned along a first surface of the first hemisphere and substantially centered with the first hemisphere; a first grooved feature positioned along a second surface of the second hemisphere, where the first grooved feature includes a first body portion and a first pair of leg portions each extending from each end of the first body portion at a first congruent angle; and a second grooved feature positioned along the second surface of the second hemisphere, where the second grooved feature includes a second body portion and a second pair of leg portions each extending from each end of the second body portion at a second congruent angle.

14 Claims, 11 Drawing Sheets

(56) References Cited

U.S. PATENT DOCUMENTS

| | | | | | |
|---|---|---|---|---|---|
| D838,417 | S | * | 1/2019 | Jiang | D21/713 |
| D844,721 | S | * | 4/2019 | Adams | D21/780 |
| D906,452 | S | * | 12/2020 | von Heland | D21/713 |
| 10,850,166 | B1 | * | 12/2020 | Zamora | A63B 37/14 |
| D911,462 | S | * | 2/2021 | Blum | D21/680 |
| D957,662 | S | * | 7/2022 | Guerizec | D24/211 |
| 2007/0155549 | A1 | * | 7/2007 | Keker | A63B 69/0002 473/613 |
| 2008/0064539 | A1 | * | 3/2008 | Mark | A63B 69/0002 473/598 |
| 2018/0042807 | A1 | * | 2/2018 | Mallory | A61H 15/0092 |

* cited by examiner

TRAINING BALL

BACKGROUND

Once a baseball player has gained a level of proficiency in the basic skills of throwing, catching, and hitting, it is common for advanced players to commence a multiyear study of the various nuances associated with their chosen (or assigned) position(s). Outfielders learn how to hit a cutoff man, catchers practice throwing from their knees, and infielders learn how to execute a double-play. However, it is possible that the most nuanced skillset on a baseball diamond belongs to the pitcher. From the time the ball enters his or her hand ending the previous play until the ball leaves his or her hand starting the next play, the majority of a pitcher's focus is on receiving a signal indicating the next pitch and then executing that pitch. At the lower levels of the game, the pitcher typically strives to throw the ball straight over the plate. However, as age and skill levels increase, the pitcher begins to try and fool the batter, moving beyond throwing a straight ball as hard as possible, and instead learns to spin the ball so as to make it curve. The mechanics of a conventional curveball have been well-characterized for many years, but the learning process has never been easy. In addition to failing to learn the requisite skills and thus exposing the player to scorn and the team to losses, a common result of amateur learning techniques associated with the teaching of a player how to throw a curving ball is fatigue of the arm, elbow, and wrist, with the possibility of short, intermediate, and long-term injury.

Thus, in view of the problems and disadvantages associated with prior art devices, training ball embodiments are presented herein.

SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented below.

As such, training balls are presented including: a solid sphere defining a first hemisphere and a second hemisphere; a tactile feature positioned along a first surface of the first hemisphere and substantially centered with the first hemisphere; a first grooved feature positioned along a second surface of the second hemisphere, where the first grooved feature includes a first body portion and a first pair of leg portions each extending from each end of the first body portion at a first congruent angle; and a second grooved feature positioned along the second surface of the second hemisphere, where the second grooved feature includes a second body portion and a second pair of leg portions each extending from each end of the second body portion at a second congruent angle, where the first body portion and the second body portion are substantially parallel, and where the first grooved feature and the second grooved feature are substantially centered with the second hemisphere along the second surface.

In some embodiments, the tactile feature includes: a center portion having at least four corners; a grooved border encompassing the center square portion; and a number of support bridges extending from each of the at least four corners to bridge the grooved border. In some embodiments, the first grooved feature includes a first depth, where the first pair of leg portions each terminate at a circular hole, the circular hole having a circular hole depth at least equal to the first depth. In some embodiments, the second grooved feature includes a second depth, where the second pair of leg portions each terminate at a circular hole, the circular hole having a circular hole depth at least equal to the second depth. In some embodiments, the tactile feature includes: a center hole portion and a surrounding depression that encompasses the center hole portion. In some embodiments, the first grooved feature and the second groove feature have a cross-sectional profile selected from the group consisting of: a circular channel profile, a semi-circular channel profile, a vee channel profile, a trapezoidal channel profile, and a rectangular channel profile. In some embodiments, training balls further include: a number of visual indicators positioned on the first and second surfaces of the training ball to indicate a number of finger placements for throwing the training ball.

In other embodiments, methods of utilizing a training ball are presented including: providing the training ball, the training ball including: a solid sphere defining a first hemisphere and a second hemisphere; a tactile feature positioned along a first surface of the first hemisphere and substantially centered with the first hemisphere; a first grooved feature positioned along a second surface of the second hemisphere, where the first grooved feature includes a first body portion and a first pair of leg portions each extending from each end of the first body portion at a first congruent angle; and a second grooved feature positioned along the second surface of the second hemisphere, where the second grooved feature includes a second body portion and a second pair of leg portions each extending from each end of the second body portion at a second congruent angle, where the first body portion and the second body portion are substantially parallel, and where the first grooved feature and the second grooved feature are substantially centered with the second hemisphere along the second surface; and grasping the training ball by aligning fingers with the tactile feature, the first grooved feature, and the second grooved feature; and throwing the training ball.

The features and advantages described in the specification are not all inclusive and, in particular, many additional features and advantages will be apparent to one of ordinary skill in the art in view of the drawings, specification, and claims. Moreover, it should be noted that the language used in the specification has been principally selected for readability and instructional purposes and may not have been selected to delineate or circumscribe the inventive subject matter.

BRIEF DESCRIPTION OF THE DRAWINGS

The present invention is illustrated by way of example, and not by way of limitation, in the figures of the accompanying drawings and in which like reference numerals refer to similar elements and in which.

DETAILED DESCRIPTION

Figure 1A:
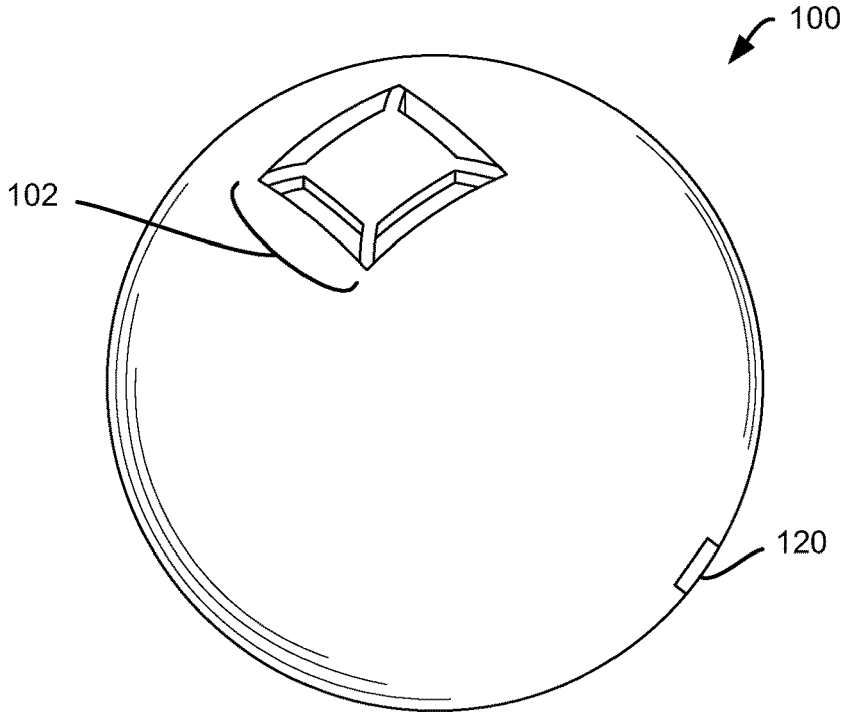
FIGS. 1A-1F are illustrative representations of a training ball having a squared center portion in accordance with embodiments of the present invention.

The present invention will now be described in detail with reference to a few embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps and/or structures have not been described in detail in order to not unnecessarily obscure the present invention.

In still other instances, specific numeric references such as "first material," may be made. However, the specific numeric reference should not be interpreted as a literal sequential order but rather interpreted that the "first material" is different than a "second material." Thus, the specific details set forth are merely exemplary. The specific details may be varied from and still be contemplated to be within the spirit and scope of the present disclosure. The term "coupled" is defined as meaning connected either directly to the component or indirectly to the component through another component. Further, as used herein, the terms "about," "approximately," or "substantially" for any numerical values or ranges indicate a suitable dimensional tolerance that allows the part or collection of components to function for its intended purpose as described herein.

Embodiments disclosed herein provide training balls that mimic the movement patterns of an actual baseball due to grooved features (i.e., imbedded channels) and tactile features (i.e., geometric shapes) on opposing hemispheres as opposed to imbalanced hemispheres caused by surface asymmetry. Non-continuous grooved and tactile features as presented herein are asymmetrical in shape and depth. This asymmetry creates turbulent airflow, which affects the flight characteristics of the training ball. Notably, training ball embodiments are substantially balanced. That is, the features may be substantially balanced on either hemisphere by varying the depth, width, and length in any combination of the surface indentations that define the feature. The substantially balanced construction provides a more realistic curve or break when pitching and a more reliable flight path when hit. Utilizing embodiments provided herein, different pitches may be achieved without using Magnus Force. Magnus Force is the force exerted on a rapidly spinning sphere moving through the air in a direction at an angle to the axis of spin. Magnus Force—which includes back spin and top spin—is largely responsible for the amount of "curve" or "break" a baseball experiences as it is traveling to the catcher. Thus, young players may effectively experience different pitching patterns by throwing training ball embodiments in a regular overhand or sidearm fashion before they have learned how to manipulate the flight pattern using Magnus Force. In the embodiments presented herein, providing a training accessory that is efficient to manufacture and safe to use, particularly by younger players, may be desirable.

Figure 1B:
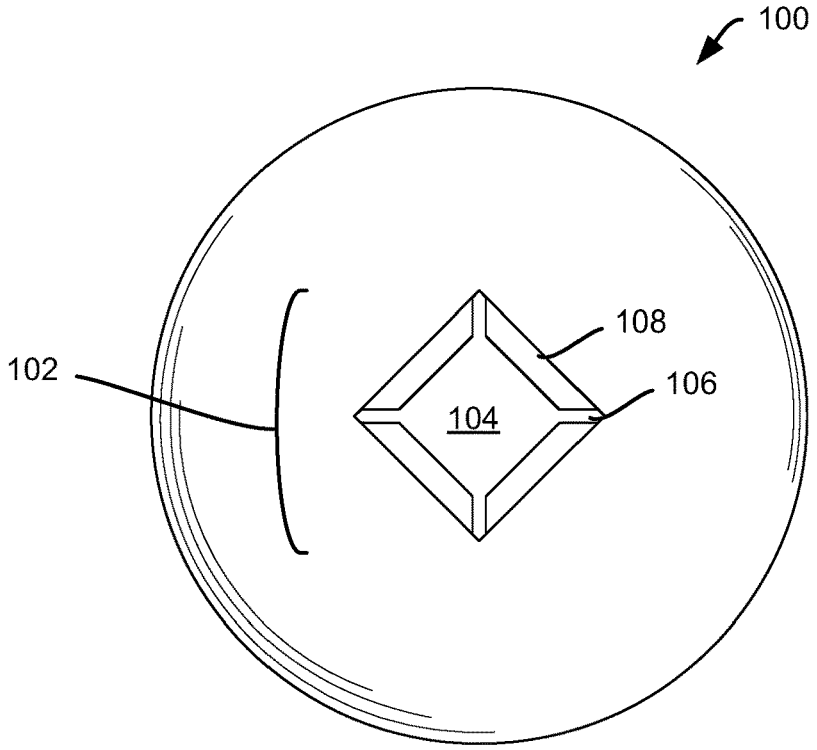

FIGS. 1A-1F are illustrative representations of a training ball having a squared center portion in accordance with embodiments of the present invention. In particular, FIG. 1A is an illustrative perspective representation of training ball 100 showing tactile feature 102 and one groove feature 110 of two groove features in embodiments presented herein. An embodiment of training ball 100 may be formed from high-density polyurethane rubber, but it should be appreciated that other natural and synthetic materials may be utilized without departing from the scope of the instant invention. A conventional baseball weighs approximately 5.25 oz. (~148 gm.) but preferred training ball 100 may weigh between approximately 0.53 to 3.17 oz. (15 to 90 gm.) depending on the size and materials utilized. The preferred training ball will define a diameter of approximately 2.0-4.0 in. (5.08-10.16 cm.), depending on the age and skill level of the intended user. As shown, training ball 100 is a solid sphere that defines two hemispheres having exterior surfaces. The various illustrations present different perspectives of training ball embodiments to provide clarity in understanding the embodiments disclosed herein. As such, FIG. 1B is an illustrative representation of training ball 100 showing a first of two hemispheres. As illustrated, the hemisphere includes tactile feature 102 that is centered with the hemisphere and is positioned along the surface of the hemisphere. Further illustrated, tactile feature 102 includes center portion 104 that is encompassed by grooved border 108. At each corner of center portion 104, support bridge 106 extends to bridge grooved border 108. In operation, the tactile feature is used to orient a user's fingers and ultimately affects flight characteristics of the training ball. The support bridges act to support the center portion as well to provide additional gripping action for the fingertips. In some embodiments, other geometry may be utilized. For example, one skilled in the art will readily appreciate that five or more corners forming different geometric shapes such as a pentagon or a hexagon may be utilized without departing from embodiments disclosed herein.

Figure 1C:
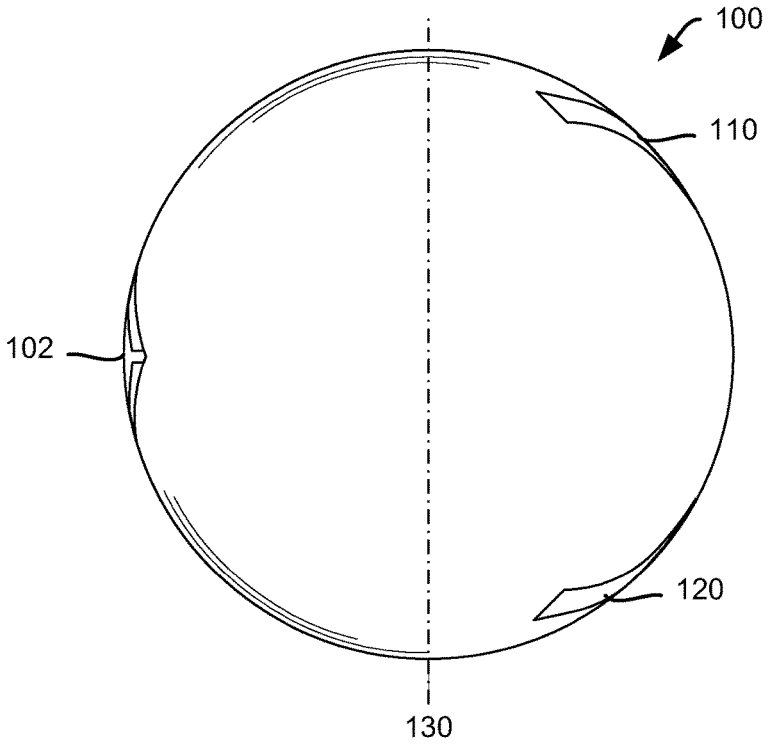
Figure 1D:
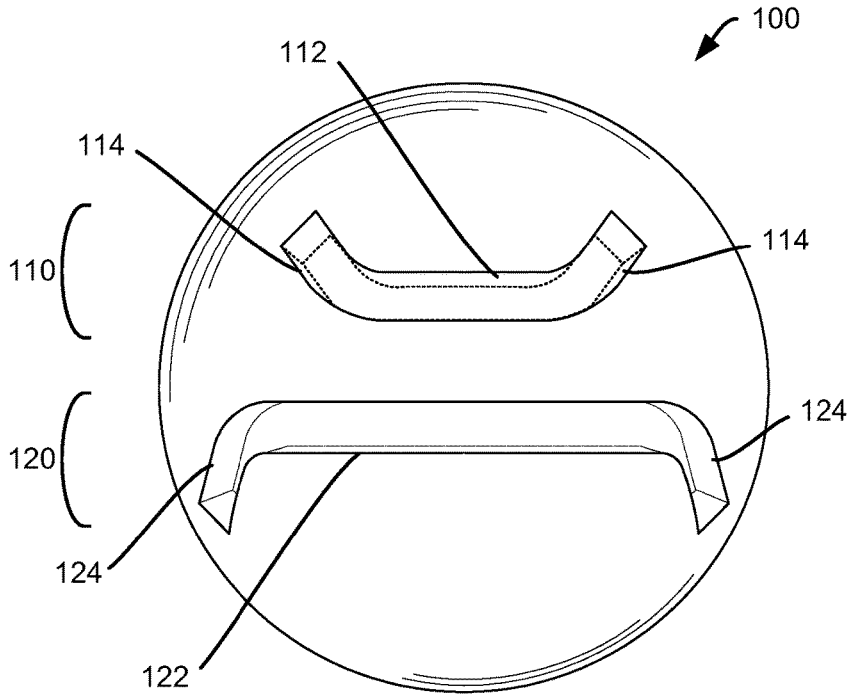

FIG. 1C is an illustrative side view representation of training ball 100 showing tactile feature 102 and grooved features 110 and 120 in embodiments presented herein. As shown, training ball 100 is a solid sphere that defines two hemispheres as demarked by line 130. The various illustrations present different perspectives of training ball embodiments to provide clarity in understanding the embodiments disclosed herein. As such, FIG. 1D is an illustrative representation of training ball 100 showing a second of two hemispheres. As illustrated, the hemisphere includes grooved feature 110 and grooved feature 120. Grooved feature embodiments are different in length as shown. Further illustrated, grooved feature 110 includes body portion 112 and leg portions 114 that extend from the body portion at substantially congruent angles. Likewise, grooved feature 120 includes body portion 122 and leg portions 124 that extend from the body portion at substantially congruent angles. In addition, the grooved features are substantially centered with the hemisphere along the surface of the hemisphere. Certain embodiments of one or more channel(s) are defined by two or more geometrically shaped portions that are connected or interlocked in non-symmetrical fashion including (but not limited to) circles, squares, and/or rectangles. The structure of these one or more channels is not intended to be construed as a limitation, and the sides of these one or more channels may be vertical, angled, or rounded. For example, grooved feature embodiments may have a cross-sectional profile such as: a circular channel profile, a semi-circular channel profile, a vee channel profile, a trapezoidal channel profile, and a rectangular channel profile. As illustrated, a rectangular channel profile is shown. In operation, the grooved features are used to orient a user's fingers. When thrown, the grooved features affect the air flow around training ball embodiments that affect the flight of the training ball. In addition, grooved features define a desired depth in embodiments. In a preferred embodiment, the desired depth of the grooved features is approximately 0.1875 in. (0.48 cm.).

Figure 1E:
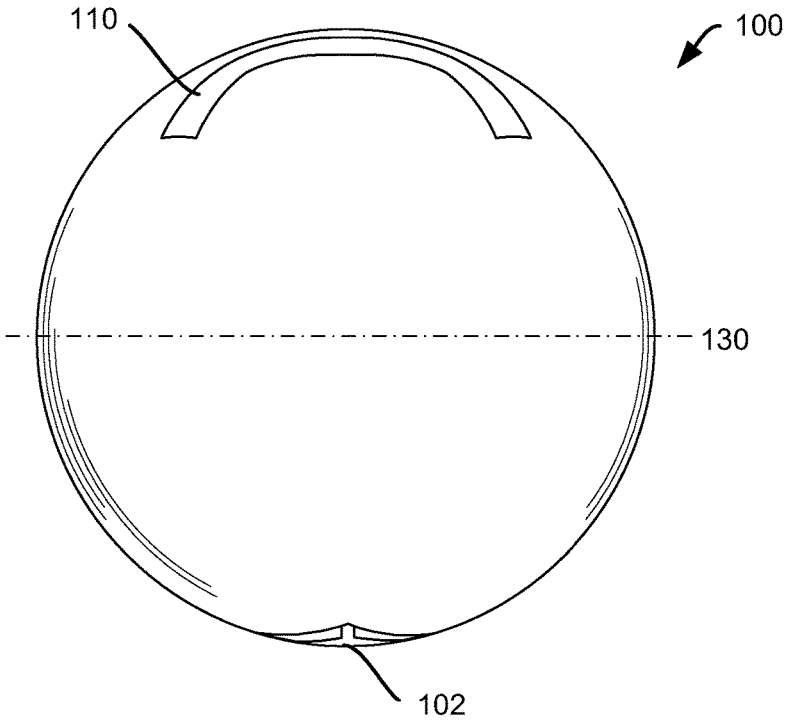
Figure 1F:
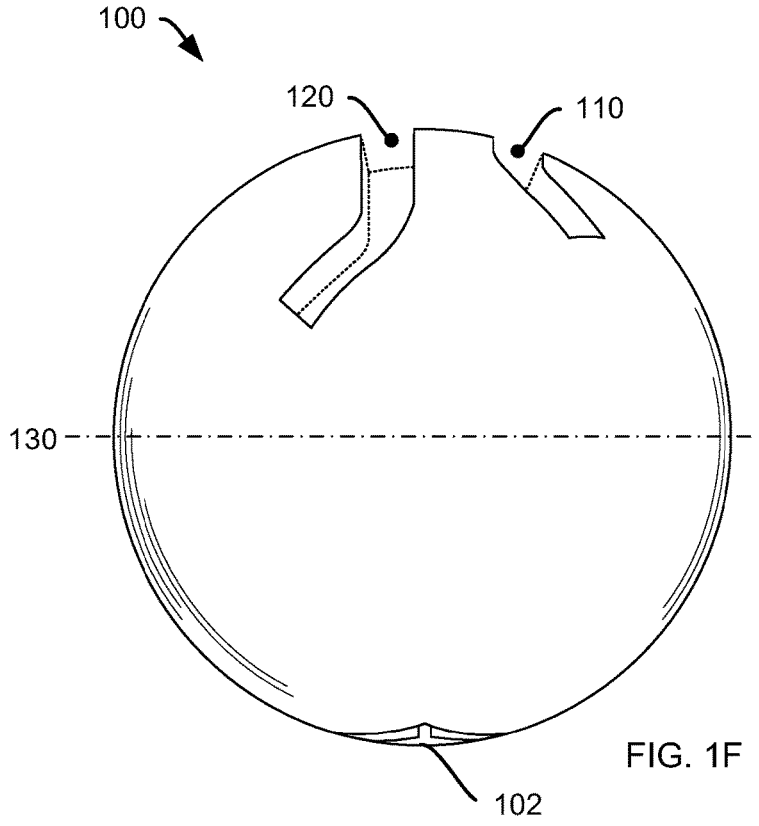

FIGS. 1E and 1F are provided to show different orientations and feature locations of training ball embodiments. As such, FIG. 1E is an illustrative side view representation of training ball 100 showing tactile feature 102 and grooved feature 110 in embodiments presented herein and FIG. 1F is an illustrative side view representation of training ball 100 showing tactile feature 102 and grooved features 110 and 120 in embodiments presented herein. As may be seen in FIG. 1F, grooved features have a rectangular channel profile. As shown, training ball 100 is a solid sphere that defines two hemispheres as demarked by line 130. It should be noted that like grooved features terminating with circular holes as shown in FIGS. 2A-2F (below), embodiments shown in FIGS. 1A-1F may also terminate with circular holes without limitation.

Figure 2A:
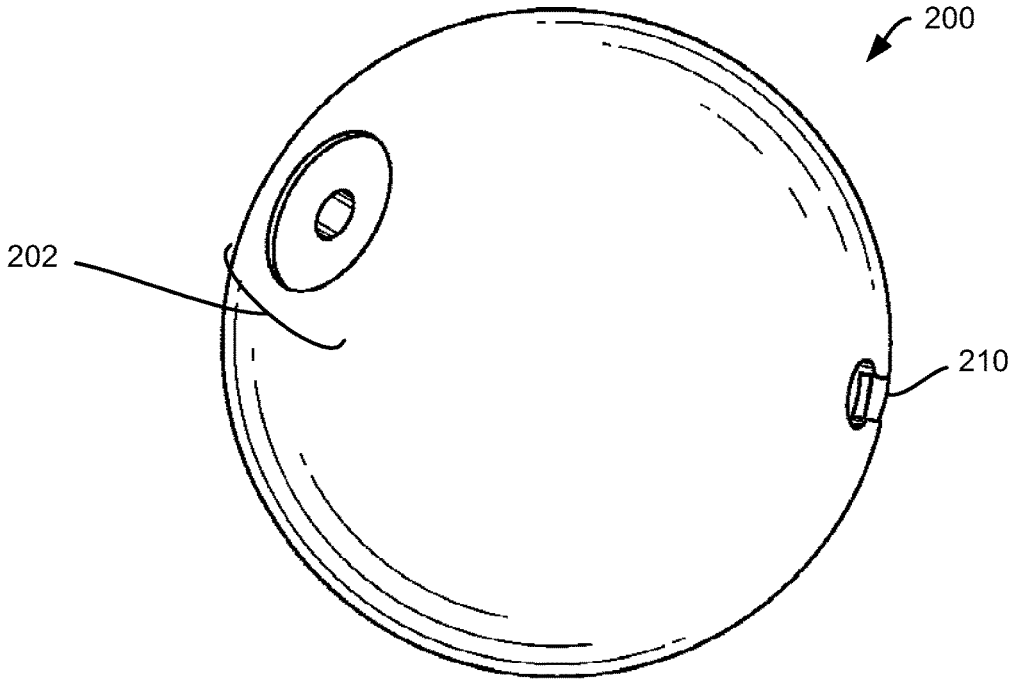
FIGS. 2A-2F are illustrative representations of a training ball having a circular center portion in accordance with embodiments of the present invention.
Figure 2B:
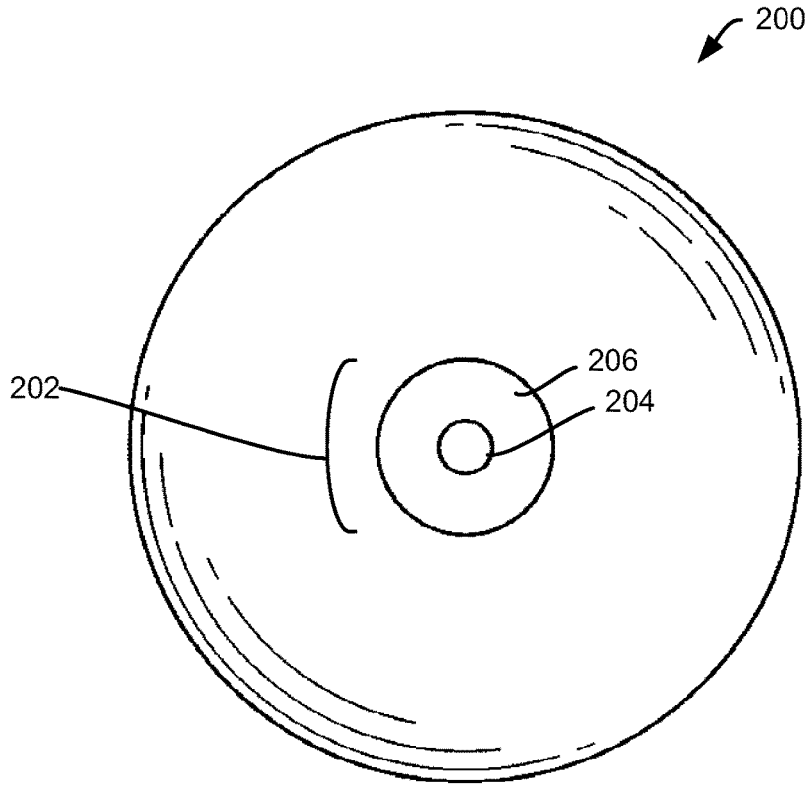

FIGS. 2A-2F are illustrative representations of a training ball having a circular center portion in accordance with embodiments of the present invention. In particular, FIG. 2A is an illustrative perspective representation of training ball 200 showing tactile feature 202 and one groove feature 210 of two groove features in embodiments presented herein. An embodiment of training ball 200 may be formed from high-density polyurethane rubber, but it should be appreciated that other natural and synthetic materials may be utilized without departing from the scope of the instant invention. A conventional baseball weighs approximately 5.25 oz. (~148 gm.) but preferred training ball 200 may weigh between approximately 0.53 to 3.17 oz. (15 to 90 gm.) depending on the size and materials utilized. The preferred training ball will define a diameter of approximately 2.0-4.0 in. (5.08-10.16 cm.), depending on the age and skill level of the intended user. As shown, training ball 200 is a solid sphere that defines two hemispheres having exterior surfaces. The various illustrations present different perspectives of training ball embodiments to provide clarity in understanding the embodiments disclosed herein. As such, FIG. 2B is an illustrative representation of training ball 200 showing a first of two hemispheres. As illustrated, the hemisphere includes tactile feature 202 that is centered with the hemisphere and is positioned along the surface of the hemisphere. Further illustrated, tactile feature 202 includes center hole portion 204 that is encompassed by surrounding depression 206. In a preferred embodiment, center hold portion 204 defines a first annular dimension with a diameter of approximately 0.7500 in. (1.91 cm.) and a depth of 0.0625 in. (0.16 cm.). In addition, in a preferred embodiment, the surrounding depression defines a second annular dimension with a diameter of 0.3125 in. (0.79 cm) and a depth of 0.3750 in. (0.95 cm). It should be understood that the number, diameter, and positioning of these respective dimensions is illustrative, and that no limiting construction is intended. Further, the shape of tactile feature embodiments should not be considered a limitation of the instant invention, as other shapes such as (but not limited to) squares, rectangles, and parallelograms are within the scope of the instant invention (see for example FIGS. 1A-1F). In operation, the tactile feature is used to orient a user's fingers and ultimately affects flight characteristics of the training ball. In addition, the surrounding depression provides additional gripping action for the fingertips.

Figure 2C:
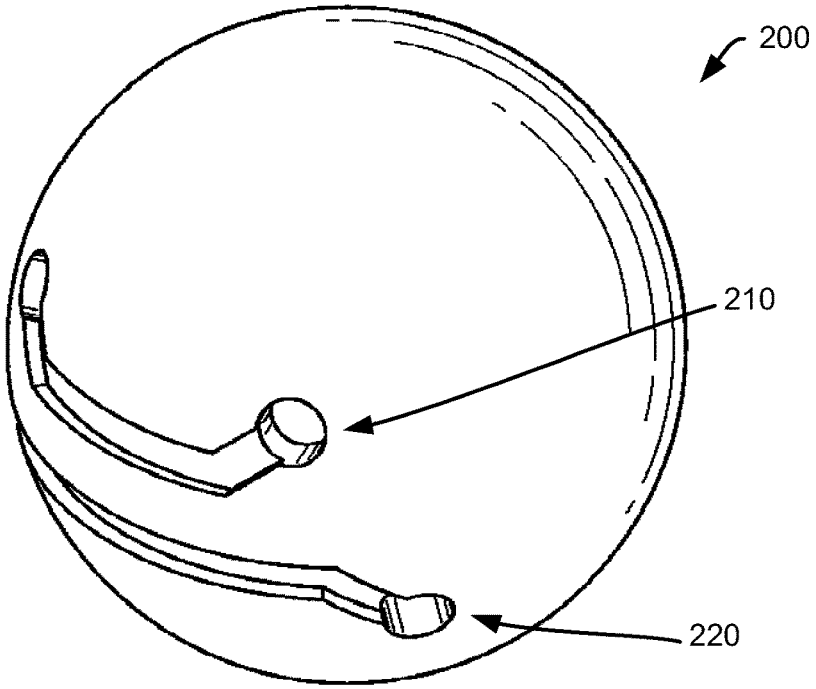
Figure 2D:
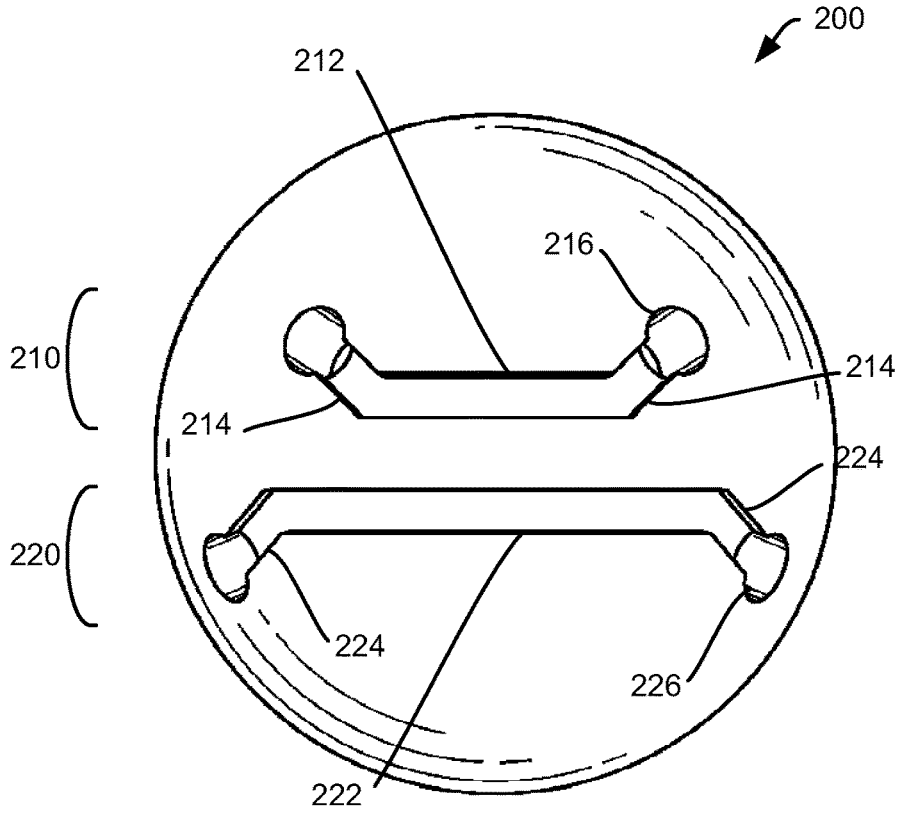

FIG. 2C is an illustrative perspective representation of training ball 200 showing grooved features 210 and 220 in embodiments presented herein. As shown, training ball 200 is a solid sphere that defines two hemispheres. The various illustrations present different perspectives of training ball embodiments to provide clarity in understanding the embodiments disclosed herein. As such, FIG. 2D is an illustrative representation of training ball 200 showing a second of two hemispheres. As illustrated, the hemisphere includes grooved feature 210 and grooved feature 220. Grooved feature embodiments are different in length as shown. Further illustrated, grooved feature 210 includes body portion 212 and leg portions 214 that extend from the body portion at substantially congruent angles. Likewise, grooved feature 220 includes body portion 222 and leg portions 224 that extend from the body portion at substantially congruent angles. In the illustrated embodiments, leg portions 214 terminate at circular hole 216. In addition, the grooved features are substantially centered with the hemisphere along the surface of the hemisphere. Certain embodiments of one or more channel(s) are defined by two or more geometrically shaped portions that are connected or interlocked in non-symmetrical fashion including (but not limited to) circles, squares, and/or rectangles. The structure of these one or more channels is not intended to be construed as a limitation, and the sides of these one or more channels may be vertical, angled, or rounded. For example, grooved feature embodiments may have a cross-sectional profile such as: a circular channel profile, a semi-circular channel profile, a vee channel profile, a trapezoidal channel profile, and a rectangular channel profile. As illustrated, a rectangular channel profile is shown. In operation, the grooved features are used to orient a user's fingers. When thrown, the grooved features affect the air flow around training ball embodiments that affect the flight of the training ball. As such, grooved features define a desired depth. In a preferred embodiment, the desired depth of the grooved features is approximately 0.1875 in. (0.48 cm). In a preferred embodiment, the depth of the circular holes is equal to or greater than the grooved feature depth.

Figure 2E:
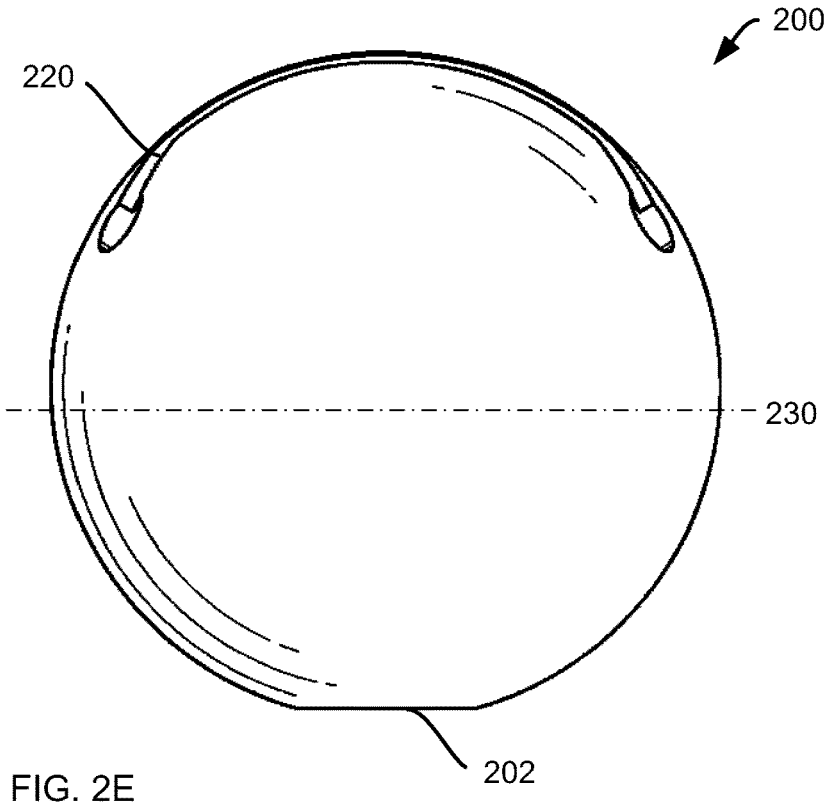
Figure 2F:
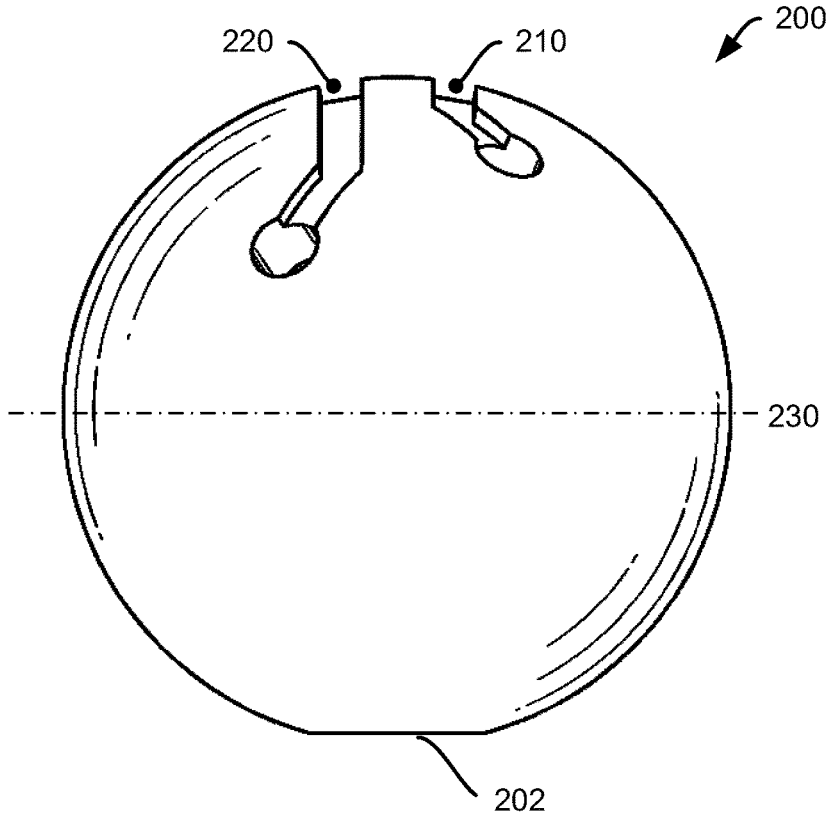

FIGS. 2E and 2F are provided to show different orientations and feature location of training ball embodiments. As such, FIG. 2E is an illustrative side view representation of training ball 200 showing tactile feature 202 and grooved feature 220 in embodiments presented herein and FIG. 2F is an illustrative side view representation of training ball 200 showing tactile feature 202 and grooved features 210 and 220 in embodiments presented herein. As shown, training ball 200 is a solid sphere that defines two hemispheres as demarked by line 230. As may be seen in FIG. 2F, grooved features have a rectangular channel profile. It should be noted that like grooved features terminating without circular holes as shown in FIGS. 1A-1F, embodiments shown in FIGS. 2A-2F may also terminate without circular holes without limitation.

Methods

Training ball embodiments disclosed herein provide for throwing, hitting, and fielding under circumstances where a conventional baseball would be impractical or undesirable. The preferred training ball is formed from high-density polyurethane rubber, defines a diameter between two and four inches, and will weigh between 15 and 90 grams. The one or more tactile features are formed in the exterior surface(s) of the hemisphere or hemispheres of the preferred training ball are formed primarily from circles, squares, and rectangles defining varying lengths that may, but are preferably not continuous or intersecting with one another. The instant training ball provides a novel training accessory that delivers the playing and training benefits of a conventional baseball with the safety and flexibility of a softer ball that simultaneously provides tactile feedback to the user during use. Training ball embodiments can be thrown, hit, and fielded in a similar manner to a conventional baseball while also serving as a training tool for instruction on the proper throwing technique of breaking pitches as well as serving as a training tool for batters who are learning to recognize and hit an assortment of breaking pitches. Conventional training accessories may generate an undesirable and unpredictable ball flight when hit and/or fielded due to their consistently asymmetrical design and construction. The alternations in laminar airflow, be it from concentric rings, grooves, or raised edges, generate laminar airflow over one hemisphere of the ball but turbulent airflow over the other hemisphere, causing the ball to curve, flutter, or otherwise unpredictably fly when hit or thrown. Contrasting with these generally solid balls are lighter and/or softer balls with a continuous loop of surface alternations that may result in a more accurate flight pattern when hit or thrown but require a novice pitcher to rely on prominent wrist rotation when throwing breaking pitches; an act that is difficult for inexperienced and/or young players increasing the likelihood of an injury. Methods for utilizing training ball embodiments are provided hereinbelow for the following figures.

Figure 3A:
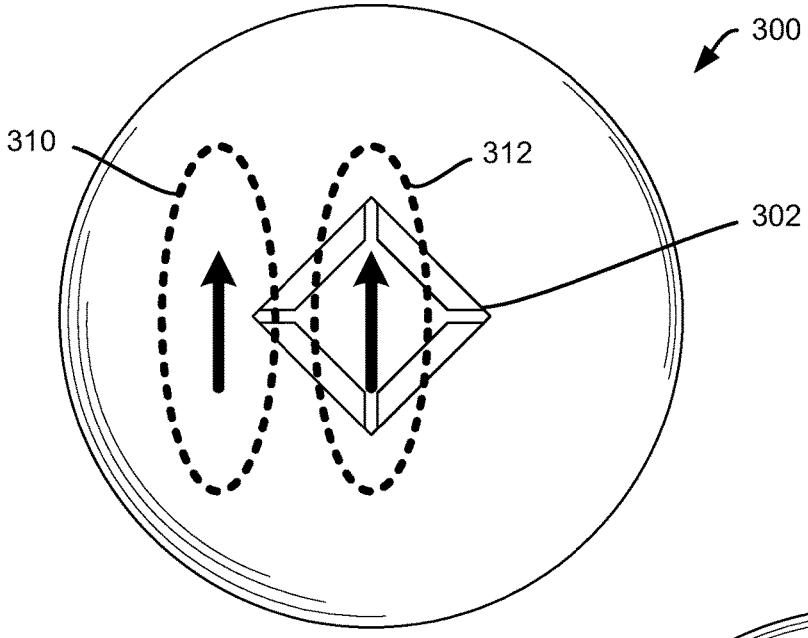
FIGS. 3A-3C are illustrative representations of a method for using a training ball in accordance with embodiments of the present invention.
Figure 3B:
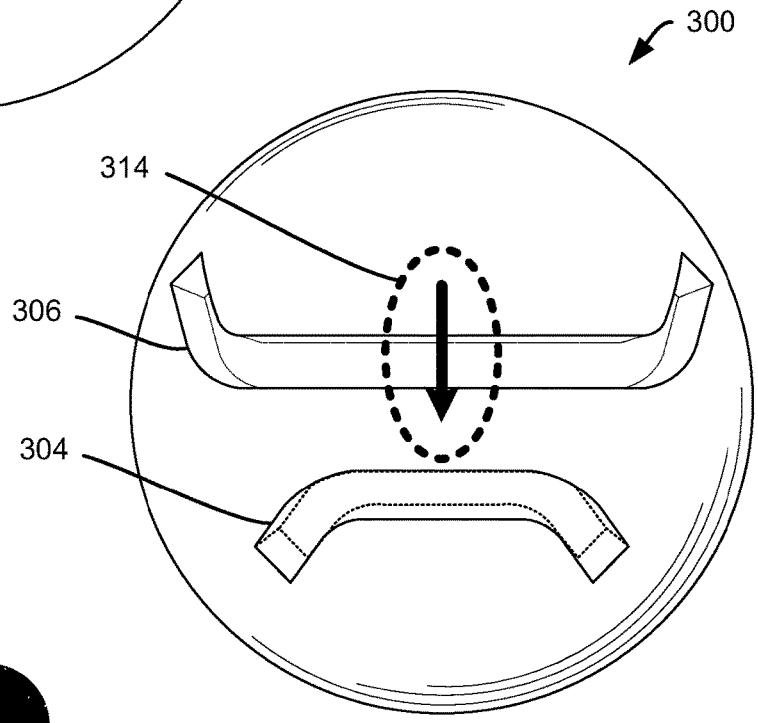
Figure 3C:
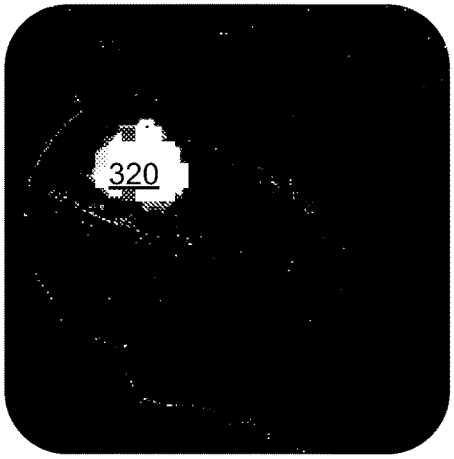

FIGS. 3A-3C are illustrative representations of a method for using a training ball in accordance with embodiments of the present invention. In particular, FIGS. 3A-3C illustrate methods for throwing an overhand fastball utilizing embodiments provided herein. As illustrated, FIG. 3A includes training ball 300 having tactile feature 302, which is located on one hemisphere of the training ball. Dotted line 310 illustrates index finger placement and 312 illustrates middle finger placement. The arrows show the direction of travel for the training ball. Further illustrated FIG. 3B includes training ball 300 having grooved features 304 and 306, which are located on the opposite hemisphere of the training ball. Dotted line 314 illustrates thumb placement. The arrows show the direction of travel for the training ball. The dotted lines are provided in these figures to show finger placement, which correspond with the tactile and grooved features. As such, once finger position is learned, then fingers may be positioned without looking at the training ball and utilizing the tactile and grooved features. In some embodiments, the dotted (or solid) lines are printed on the surface of the training ball and in other embodiments the dotted lines are not printed on the surface of the training ball. Printing the dotted lines provides visual placement for a pitcher as well as visual identification of spin for a batter. In some embodiments, a logo may be printed on training ball embodiments to provide visual identification of spin for a batter. FIG. 3C illustrates the finger placement of hand 322 on training ball 320 corresponding with FIGS. 3A and 3B. As such, methods illustrated for throwing an overhand fastball include at least: providing training ball 300; grasping training ball 300 by placing middle finger 312 across tactile feature 302; placing index finger 310 along tactile feature 302; placing thumb 314 across a middle body portion of grooved feature 306; and throwing training ball 300.

Figure 4A:
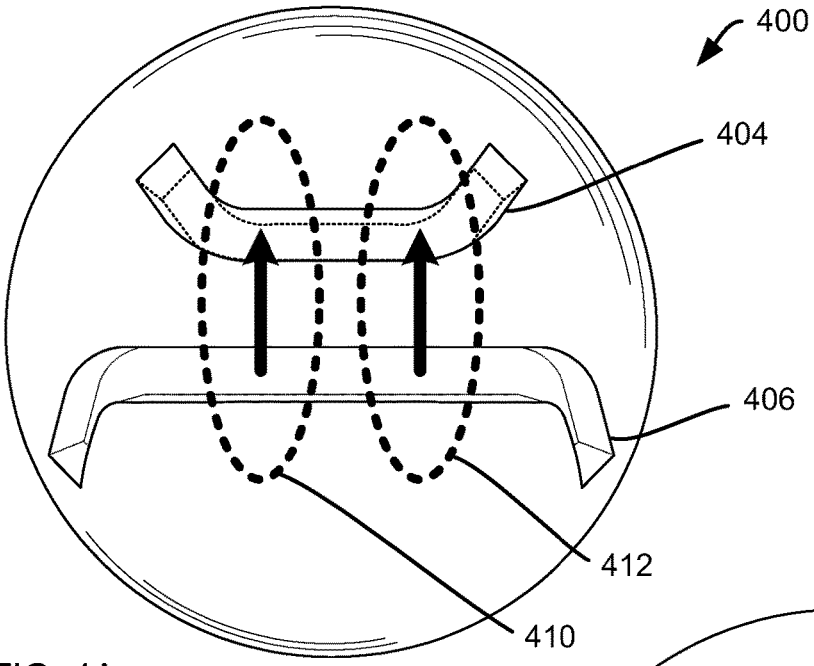
FIGS. 4A-4C are illustrative representations of a method for using a training ball in accordance with embodiments of the present invention.
Figure 4B:
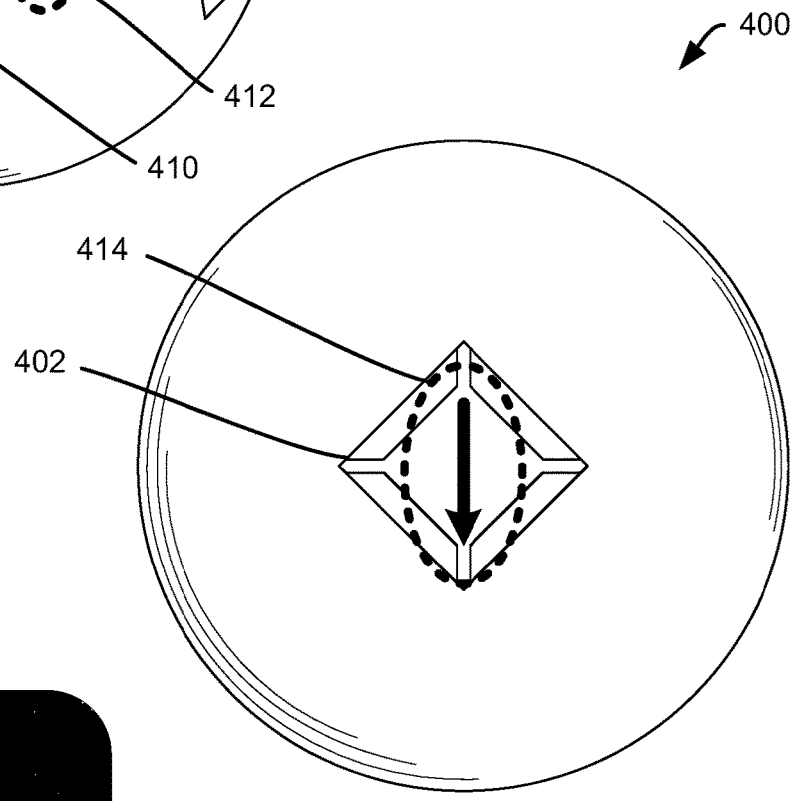
Figure 4C:
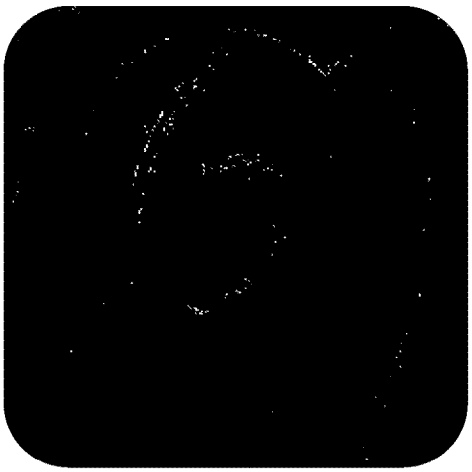

FIGS. 4A-4C are illustrative representations of a method for using a training ball in accordance with embodiments of the present invention. In particular, FIGS. 4A-4C illustrate methods for throwing a sidearm fastball utilizing embodiments provided herein. As illustrated, FIG. 4A includes training ball 400 having grooved features 404 and 406, which are located on one hemisphere of the training ball. Dotted line 410 illustrates index finger placement and dotted 412 illustrates middle finger placement. The arrows show the direction of travel for the training ball. Further illustrated, FIG. 4B includes training ball 400 having tactile feature 402, which is located on the opposite hemisphere of the training ball. Dotted line 414 illustrates thumb placement. The arrows show the direction of travel for the training ball. The dotted lines are provided in these figures to show finger placement, which correspond with the tactile and grooved features. As such, once finger position is learned, then fingers may be positioned without looking at the training ball and utilizing the tactile and grooved features. In some embodiments, the dotted (or solid) lines are printed on the surface of the training ball and in other embodiments the dotted lines are not printed on the surface of the training ball. Printing the dotted lines provides visual placement for a pitcher as well as visual identification of spin for a batter. In some embodiments, a logo may be printed on training ball embodiments to provide visual identification of spin for a batter. FIG. 4C illustrates the finger placement of hand 422 on training ball 420 corresponding with FIGS. 4A and 4B. As such, methods illustrated for throwing a sidearm fastball include at least: providing training ball 400; grasping training ball 400 by placing index finger 410 across the body portions of grooved features 410 and 412; placing middle finger 412 across the body portions of grooved features 410 and 412; placing thumb 414 on tactile feature 402; and throwing training ball 400.

Figure 5A:
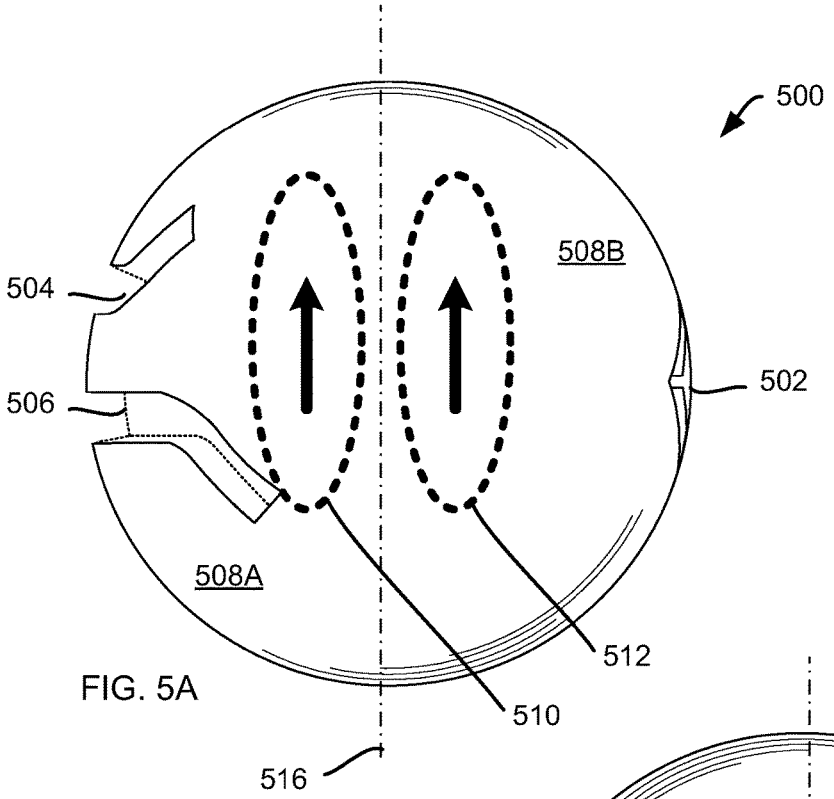
FIGS. 5A-5C are illustrative representations of a method for using a training ball in accordance with embodiments of the present invention.
Figure 5B:
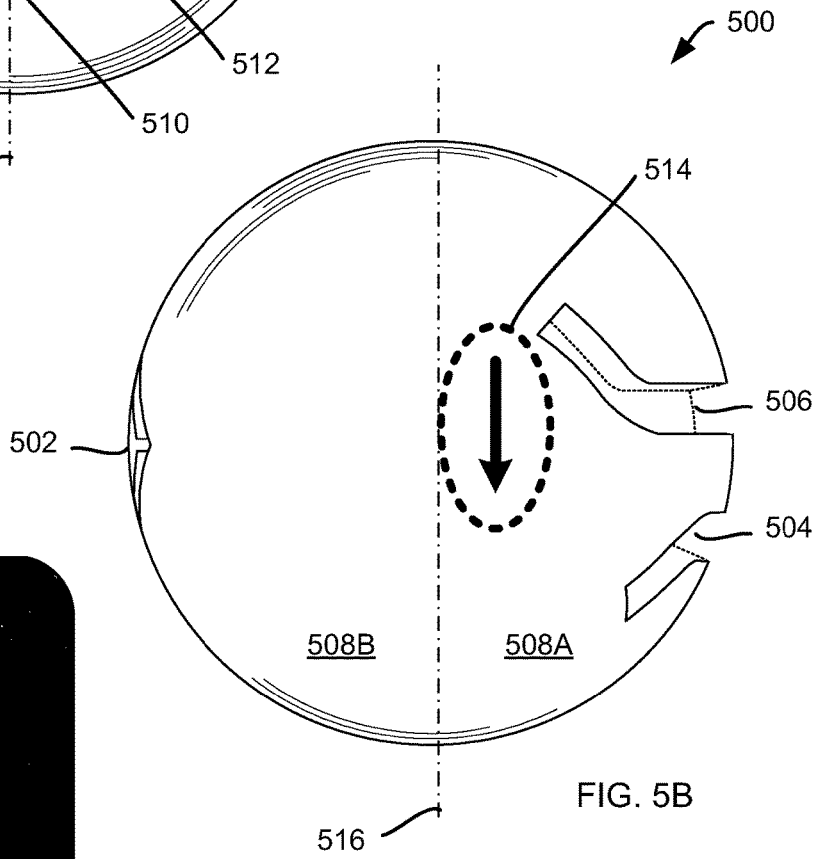
Figure 5C:
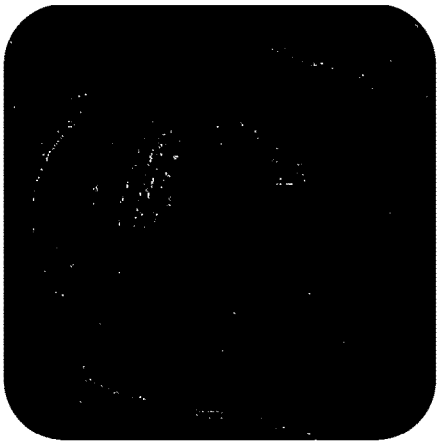

FIGS. 5A-5C are illustrative representations of a method for using a training ball in accordance with embodiments of the present invention. In particular, FIGS. 5A-5C illustrate methods for throwing an overhand curveball or a sidearm curveball utilizing embodiments provided herein. As illustrated, FIG. 5A includes training ball 500 having grooved features 504 and 506, which are located on one hemisphere of the training ball. Dotted line 510 illustrates index finger placement and dotted 512 illustrates middle finger placement. Finger placements 510 and 512 are positioned along line 516, which delineates the two hemispheres 508A and 508B of training ball 500. The arrows show the direction of travel for the training ball. Further illustrated, FIG. 5B includes training ball 500 having tactile feature 502, which is located on the opposite hemisphere of the training ball. Dotted line 514 illustrates thumb placement. The arrows show the direction of travel for the training ball. The dotted lines are provided in these figures to show finger placement, which correspond with the tactile and grooved features. As such, once finger position is learned, then fingers may be positioned without looking at the training ball and utilizing the tactile and grooved features. In some embodiments, the dotted (or solid) lines are printed on the surface of the training ball and in other embodiments the dotted lines are not printed on the surface of the training ball. Printing the dotted lines provides visual placement for a pitcher as well as visual identification of spin for a batter. In some embodiments, a logo may be printed on training ball embodiments to provide visual identification of spin for a batter. FIG. 5C illustrates the finger placement of hand 522 on training ball 520 corresponding with FIGS. 5A and 5B. As such, methods illustrated for throwing an overhand curveball or a sidearm curveball include at least: providing training ball 500; grasping training ball 500 by placing index finger 510 proximately with grooved features 504 and 506 on hemisphere 508A; placing middle finger 512 along index finger 510 and on hemisphere 508B; placing thumb 514 proximately with grooved feature 506 on hemisphere 508A; and throwing training ball 500.

Figure 6A:
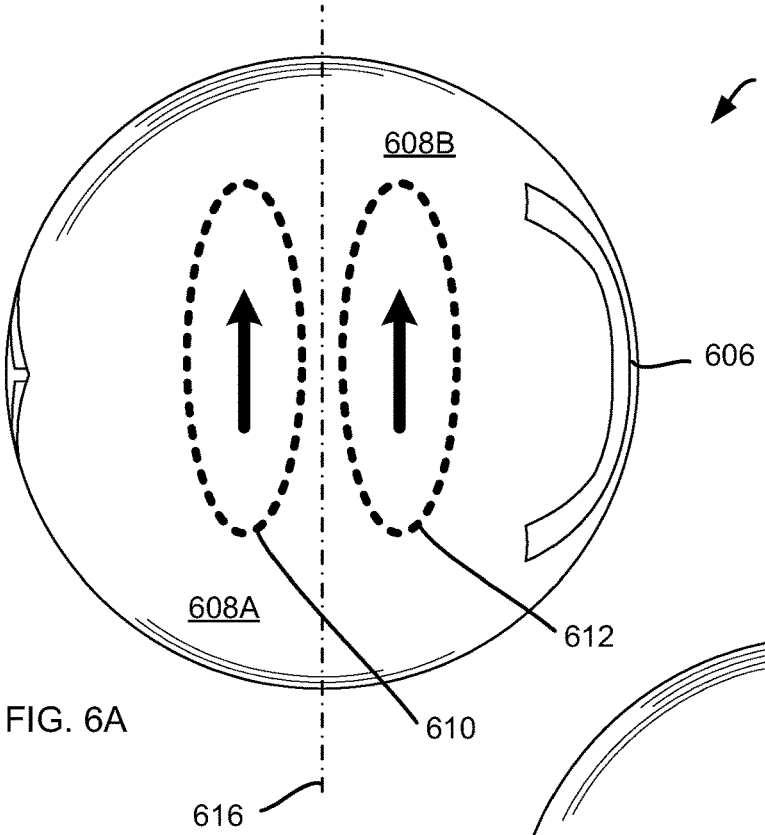
FIGS. 6A-6C are illustrative representations of a method for using a training ball in accordance with embodiments of the present invention.
Figure 6B:
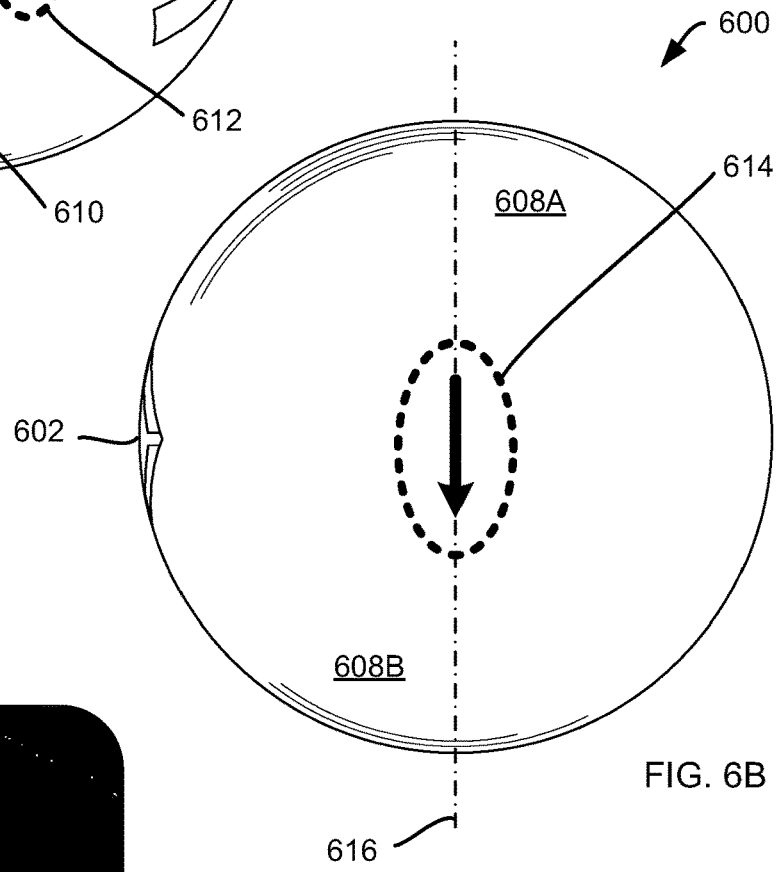
Figure 6C:
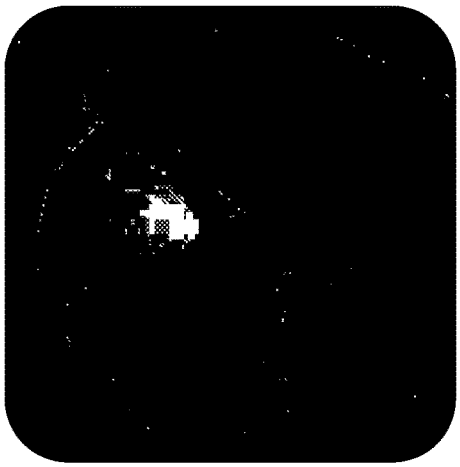

FIGS. 6A-6C are illustrative representations of a method for using a training ball in accordance with embodiments of the present invention. In particular, FIGS. 6A-6C illustrate methods for throwing an overhand screwball or a sidearm sinker utilizing embodiments provided herein. As illustrated, FIG. 6A includes training ball 600 having grooved feature 606, which is located on one hemisphere of the training ball. Dotted line 610 illustrates index finger placement and dotted line 612 illustrates middle finger placement. Finger placements 610 and 612 are positioned along line 616, which delineates the two hemispheres 608A and 608B of training ball 600. The arrows show the direction of travel for the training ball. Further illustrated, FIG. 6B includes training ball 600 having tactile feature 602, which is located on the opposite hemisphere of the training ball. Dotted line 614 illustrates thumb placement. The arrows show the direction of travel for the training ball. The dotted lines are provided in these figures to show finger placement, which correspond with the tactile and grooved features. As such, once finger position is learned, then fingers may be positioned without looking at the training ball and utilizing the tactile and grooved features. In some embodiments, the dotted (or solid) lines are printed on the surface of the training ball and in other embodiments the dotted lines are not printed on the surface of the training ball. Printing the dotted lines provides visual placement for a pitcher as well as visual identification of spin for a batter. In some embodiments, a logo may be printed on training ball embodiments to provide visual identification of spin for a batter. FIG. 6C illustrates the finger placement of hand 622 on training ball 620 corresponding with FIGS. 6A and 6B. As such, methods illustrated for throwing an overhand screwball or a sidearm sinker include at least: providing training ball 600; grasping training ball 600 by placing index finger 610 on hemisphere 608A; placing middle finger 612 along index finger 610 and on hemisphere 608B; placing thumb 614 on hemispheres 608A and 608B opposite index and middle fingers; and throwing training ball 600.

Figure 7A:
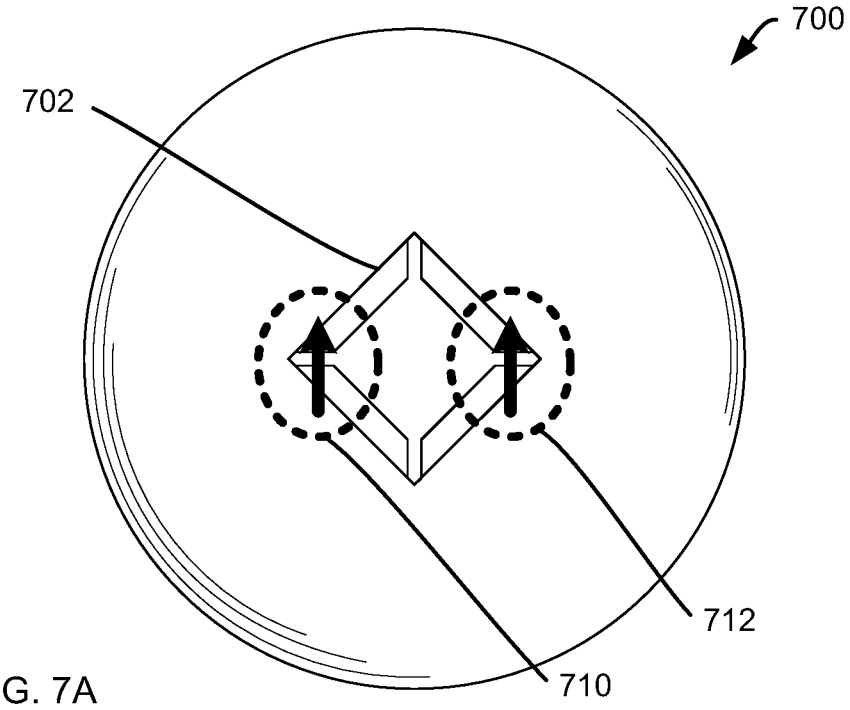
FIGS. 7A-7B are illustrative representations of a method for using a training ball in accordance with embodiments of the present invention.
Figure 7B:
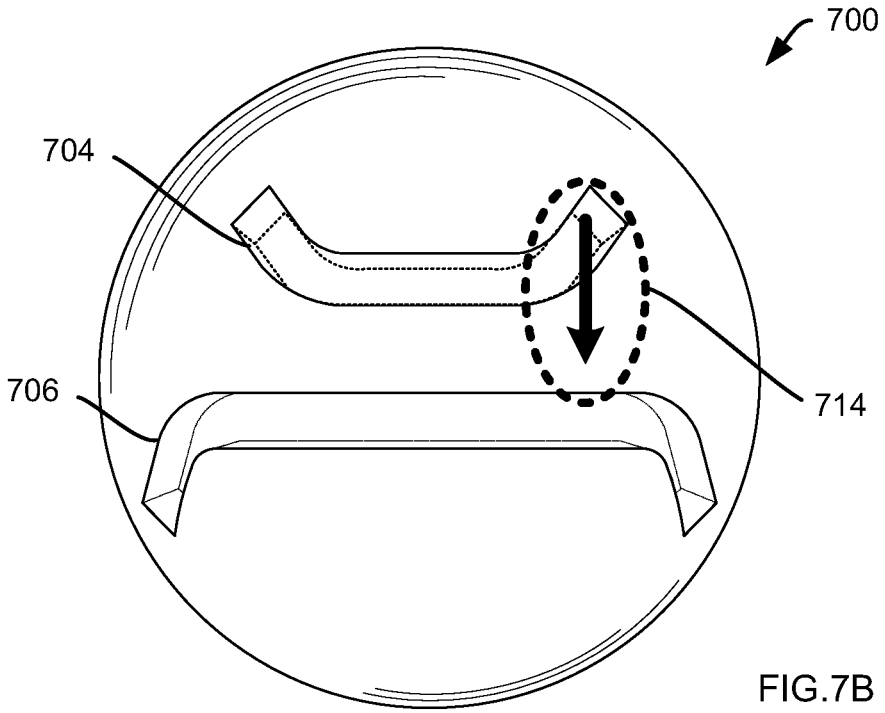

FIGS. 7A-7B are illustrative representations of a method for using a training ball in accordance with embodiments of the present invention. In particular, FIGS. 7A-7C illustrate methods for throwing an overhand knuckleball utilizing embodiments provided herein. As illustrated, FIG. 7A includes training ball 700 having tactile feature 702, which is located on one hemisphere of the training ball. Dotted line 710 illustrates index fingertip placement and 712 illustrates middle fingertip placement. The arrows show the direction of travel for the training ball. Further illustrated FIG. 7B includes training ball 700 having grooved features 704 and 706, which are located on the opposite hemisphere of the training ball. Dotted line 714 illustrates thumb placement. The arrows show the direction of travel for the training ball. The dotted lines are provided in these figures to show finger placement, which correspond with the tactile and grooved features. As such, once finger position is learned, then fingers may be positioned without looking at the training ball and utilizing the tactile and grooved features. In some embodiments, the dotted (or solid) lines are printed on the surface of the training ball and in other embodiments the dotted lines are not printed on the surface of the training ball. Printing the dotted lines provides visual placement for a pitcher as well as visual identification of spin for a batter. In some embodiments, a logo may be printed on training ball embodiments to provide visual identification of spin for a batter. As such, methods illustrated for throwing an overhand fastball include at least: providing training ball 700; grasping training ball 700 by placing index fingertip 710 along a distal corner of tactile feature 702; placing middle fingertip 712 along a proximal corner of the tactile feature; placing thumb 714 along a proximal end of grooved feature 704; and throwing training ball 700.

The terms "certain embodiments", "an embodiment", "embodiment", "embodiments", "the embodiment", "the embodiments", "one or more embodiments", "some embodiments", and "one embodiment" mean one or more (but not all) embodiments unless expressly specified otherwise. The terms "including", "comprising", "having" and variations thereof mean "including but not limited to", unless expressly specified otherwise. The enumerated listing of items does not imply that any or all of the items are mutually exclusive, unless expressly specified otherwise. The terms "a", "an" and "the" mean "one or more", unless expressly specified otherwise.

While this invention has been described in terms of several embodiments, there are alterations, permutations, and equivalents, which fall within the scope of this invention. It should also be noted that there are many alternative ways of implementing the methods and apparatuses of the present invention. Furthermore, unless explicitly stated, any method embodiments described herein are not constrained to a particular order or sequence. Further, the Abstract is provided herein for convenience and should not be employed to construe or limit the overall invention, which is expressed in the claims. It is therefore intended that the following appended claims be interpreted as including all such alterations, permutations, and equivalents as fall within the true spirit and scope of the present invention.

What is claimed is:

1. A training ball comprising:

a solid sphere defining a first hemisphere and a second hemisphere;

a tactile feature positioned along a first surface of the first hemisphere and substantially centered with the first hemisphere, wherein the tactile feature comprises:

a center portion having at least four corners;

a grooved border encompassing the center square portion; and a plurality of support bridges extending from each of the at least four corners to bridge the grooved border;

a first grooved feature positioned along a second surface of the second hemisphere, wherein the first grooved feature includes a first body portion and a first pair of leg portions each extending from each end of the first body portion at a first congruent angle; and a second grooved feature positioned along the second surface of the second hemisphere, wherein the second grooved feature includes a second body portion and a second pair of leg portions each extending from each end of the second body portion at a second congruent angle, wherein the first body portion and the second body portion are substantially parallel, and wherein the first grooved feature and the second grooved feature are substantially centered with the second hemisphere along the second surface.

2. The training ball of claim 1, wherein the first grooved feature comprises a first depth, and wherein the first pair of leg portions each terminate at a circular hole, the circular hole having a circular hole depth at least equal to the first depth.

3. The training ball of claim 1, wherein the second grooved feature comprises a second depth, and wherein the second pair of leg portions each terminate at a circular hole, the circular hole having a circular hole depth at least equal to the second depth.

4. The training ball of claim 1, wherein the first grooved feature comprises a first depth, and wherein the first pair of leg portions each terminate at a circular hole, the circular hole having a circular hole depth greater than the first depth.

5. The training ball of claim 1, wherein the second grooved feature comprises a second depth, and wherein the second pair of leg portions each terminate at a circular hole, the circular hole having a circular hole depth greater than the second depth.

6. The training ball of claim 1, wherein the first grooved feature and the second groove feature have a cross-sectional profile selected from the group consisting of: a circular channel profile, a semi-circular channel profile, a vee channel profile, a trapezoidal channel profile, and a rectangular channel profile.

7. The training ball of claim 1 further comprising:

a plurality of visual indicators positioned on the first and second surfaces of the training ball to indicate a plurality of finger placements for throwing the training ball.

8. A method of utilizing a training ball comprising:

providing the training ball, the training ball comprising:

a solid sphere defining a first hemisphere and a second hemisphere;

a tactile feature positioned along a first surface of the first hemisphere and substantially centered with the first hemisphere, wherein the tactile feature comprises:

a center portion having at least four corners;

a grooved border encompassing the center square portion; and a plurality of support bridges extending from each of the at least four corners to bridge the grooved border;

a first grooved feature positioned along a second surface of the second hemisphere, wherein the first grooved feature includes a first body portion and a first pair of leg portions each extending from each end of the first body portion at a first congruent angle; and a second grooved feature positioned along the second surface of the second hemisphere, wherein the second grooved feature includes a second body portion and a second pair of leg portions each extending from each end of the second body portion at a second congruent angle, wherein the first body portion and the second body portion are substantially parallel, and wherein the first grooved feature and the second grooved feature are substantially centered with the second hemisphere along the second surface; and grasping the training ball; and throwing the training ball.

9. The method of claim 8, wherein the grasping to throw an overhand fastball comprises:

placing a middle finger across the tactile feature;

placing an index finger along the tactile feature; and placing a thumb across a middle of the second body portion.

10. The method of claim 8, wherein the grasping to throw a sidearm fastball comprises:

placing an index finger across the first and second body portions;

placing a middle finger across the first and second body portions; and placing a thumb on the tactile feature.

11. The method of claim 8, wherein the grasping to throw an overhand curveball or a sidearm curveball comprises:

placing an index finger proximately with the first and second grooved features on the second hemisphere;

placing a middle finger along the index finger and on the first hemisphere; and placing a thumb proximately with the second grooved feature on the second hemisphere.

12. The method of claim 8, wherein the grasping to throw an overhand screwball or a sidearm sinker comprises:

placing an index finger on the first hemisphere;

placing a middle finger along the index finger and on the second hemisphere; and placing a thumb on the first and second hemisphere and opposite the index and middle fingers.

13. The method of claim 8, wherein the grasping to throw an overhand knuckleball comprises:

placing an index fingertip along a distal corner of the tactile feature;

placing a middle fingertip along a proximal corner of the tactile feature; and placing a thumb along a proximal end of the first grooved feature.

14. A training ball comprising:

a solid sphere defining a first hemisphere and a second hemisphere;

a tactile feature positioned along a first surface of the first hemisphere and substantially centered with the first hemisphere, wherein the tactile feature comprises:

a center hole portion; and a surrounding depression that encompasses the center hole portion;

a first grooved feature positioned along a second surface of the second hemisphere, wherein the first grooved feature includes a first body portion and a first pair of leg portions each extending from each end of the first body portion at a first congruent angle; and a second grooved feature positioned along the second surface of the second hemisphere, wherein the second grooved feature includes a second body portion and a second pair of leg portions each extending from each end of the second body portion at a second congruent angle, wherein the first body portion and the second body portion are substantially parallel, and wherein the first grooved feature and the second grooved feature are substantially centered with the second hemisphere along the second surface.

* * * * *